United States Patent [19]

Mecke et al.

[11] Patent Number: 5,019,421

[45] Date of Patent: May 28, 1991

[54] METHOD OF MAKING A THERMOCOLOR RIBBON FOR A THERMAL PRINTING PROCESS

[75] Inventors: Norbert Mecke, Hanover; Heinrich Krauter, Neustadt, both of Fed. Rep. of Germany

[73] Assignee: Pelikan Aktiengesellschaft, Hanover, Fed. Rep. of Germany

[21] Appl. No.: 351,624

[22] Filed: May 12, 1989

[30] Foreign Application Priority Data

May 16, 1988 [DE] Fed. Rep. of Germany ..... 3816636

[51] Int. Cl.[5] ..... B41M 3/12

[52] U.S. Cl. ..... 427/152; 427/385.5; 427/395; 427/407.1; 427/411

[58] Field of Search ..... 427/146, 152, 385.5, 427/395, 411, 407.1

[56] References Cited

U.S. PATENT DOCUMENTS

| | | | |
|---|---|---|---|
| 3,482,513 | 12/1969 | Michalchik et al. | 427/148 |
| 4,461,586 | 7/1984 | Kawanishi et al. | 427/148 |
| 4,547,088 | 10/1985 | Shattuck | 427/148 |
| 4,744,685 | 5/1988 | Mecke et al. | 400/241.4 |
| 4,820,551 | 4/1989 | Krauter et al. | 427/241 |

OTHER PUBLICATIONS

IBM Technical Disclosure Bulletin, vol. 24, No. 10, Mar. 1982: "Two-Ribbon Manufacture from Single Substrate".

*Primary Examiner*—Janyce Bell

*Attorney, Agent, or Firm*—Herbert Dubno

[57] ABSTRACT

A thermal transfer meltable color layer receives a protective polymer coating on the side thereof, to be contacted with the thermal printing head to hold the meltable color material away from the printing head, thereby forming a thermal printing ribbon without the need for a support foil.

8 Claims, 1 Drawing Sheet

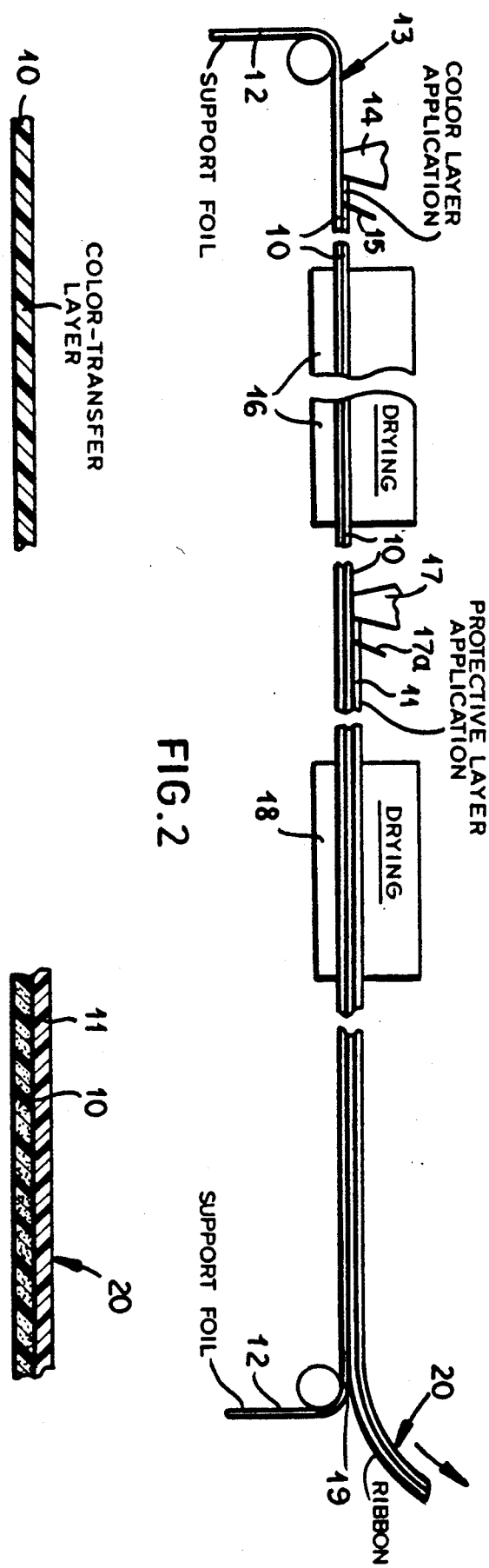
FIG.2
FIG.1A
FIG.1B
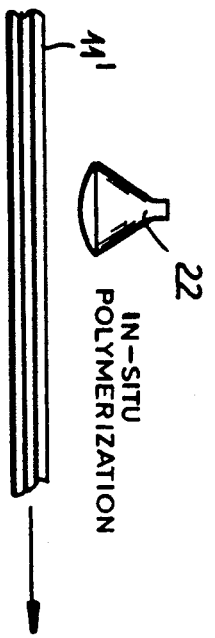
FIG.3

METHOD OF MAKING A THERMOCOLOR RIBBON FOR A THERMAL PRINTING PROCESS

CROSS-REFERENCE TO RELATED APPLICATION

This application is related to the following commonly owned copending applications Ser. No. 07/109,489 filed Oct. 15, 1987, now U.S. Pat. No. 4,895,465;

Ser. No. 07/152,645 filed Feb. 5, 1988;

Ser. No. 07/154,651 filed Feb. 10, 1988 now U.S. Pat. No. 4,898,486;

Ser. No. 07/234,970 filed Aug. 19, 1988; and

Ser. No. 07/272,599 filed Nov. 16, 1988.

Reference is also made to the following patents:

U.S. Pat. No. 4,592,945 issued June 3, 1986;

U.S. Pat. No. 4,675,063 issued June 23, 1987; and

U.S. Pat. No. 4,744,685.

1. Field of the Invention

Our present invention relates to a method of making a thermocolor ribbon, especially a thermocarbon ribbon, for use in a thermal transfer process of the type in which the ribbon has a color transfer region juxtaposed with a substrate to receive a print, e.g. a paper sheet which can be displaced by a platen, and a print head is provided to press the ribbon against the substrate while bringing the ribbon to the requisite temperature to effect a melting of the color transfer layer and the transfer of an appropriate symbol to the substrate. Generally, the color transfer layer comprises a wax-bonded or plastic-bonded melt color at least on the side turned toward the substrate to receive the print and from which a portion of the color transfer layer is bonded to the paper after melting to form the printed symbol thereon.

2. Background of the Invention

Thermocolor ribbons have long been known. Generally, they comprise a preformed foil-like carrier, for example, of paper or plastic onto which the color transfer layer with the melt color is applied. The latter can comprise a meltable wax-bonded or plastic-bonded coloring agent or carbon black layer.

The melt color, upon the use of such thermocolor ribbons, can be melted by the action of a thermal printing head to transfer the symbols, which can be alphanumeric characters, to the substrate which may be a receiving paper or foil. In general, such ribbons are referred to as thermal transfer ribbons or "TCR" ribbons (thermal carbon ribbons). Thermal printers which utilize heat to transfer a symbol to a substrate with such ribbons are known, for example, from German Patent documents DE-AS 2,062,494 and DE-AS 2,406,613 as well as DE-OS 3,224,445.

During the printing process with a thermocolor ribbon, the following operations generally take place: the printing head of a thermal printer presses the thermocolor ribbon against the receiving substrate. The printing head develops a temperature which is sufficient to melt the melt color, but generally is a maximum of about 400° C.

The uncoated backside of the thermocolor ribbon, namely, the foil-like carrier remains during the printing process in direct contact with the print head or the hot print symbol, e.g. a typeface. In the relatively short time required for the printing process, the relative speed between the thermocolor ribbon and receiving paper or foil is zero. The coating on the carrier is melted in the pattern of the symbol and is transferred to the receiving substrate when the pressure from the print head is withdrawn, the transferred melt color remains adherent to the paper as the ribbon is pulled back therefrom.

Mention may also be made of another process which also uses thermocolor ribbons, but wherein the symbol transfer is not effected by the use of a heated symbol of the printing head, but rather is a consequence of resistance heating generated in a special foil-like carrier. The melt color used forms a functional layer which is locally brought to a temperature sufficient to melt the layer by resistance heating for transfer of the symbol. Since the ribbon is electrically conductive, in the field the process is referred to as an electrothermal process and the ribbon as an electrothermal ribbon. Such a thermal transfer printing system is described, for example, in U.S. Pat. No. 4,309,117.

Commercially available thermocolor ribbons at the present time primarily make use of a foil-like carrier which is constituted of a polyester or polycarbonate as a rule. The provision of such carriers involves high material costs. Recycling of the foil after use of the ribbon is impractical.

As a consequence, it has been proposed in European Patent Publication EP-A-0 120 230 to provide a thermal color ribbon of a special structure such that no carrier foil is required and thereby the ribbon can be manufactured at low cost.

In this system, the melt color is composed of a first hard polymer, a film-forming material, a second polymer which is an adhesive or an agent of low melting point, and a color releasing material.

This thermocolor ribbon must have sufficient tensile strength to allow it to be self-supporting and pulled along the ribbon path. It has been found in practice, however, that it is necessary to support this ribbon along its path by an endless belt. The endless belt, of course, is an additional mechanical element so that apparatus is made more costly and, naturally a special printer must be used.

OBJECTS OF THE INVENTION

The principal object of our invention, therefore, is to provide a thermocolor ribbon and a method of making same which is free from the aforementioned drawbacks and, particularly, does not require any expensive preformed carrier foil, but can be used in a conventional thermal printer without an additional supporting endless belt as previously described.

Another object of the invention is to provide an improved method of making a thermocolor ribbon which is of low cost and yet of sufficient tensile strength and integrity as to enable it to be used in a manner similar to that now employed for thermocolor ribbons having preformed carrier foils.

SUMMARY OF THE INVENTION

These objects and others which will become more apparent hereinafter are attained, in accordance with the present invention, in a method of making a thermocolor ribbon, especially a thermocolor ribbon without a carrier foil and which comprises:

(a) forming a transfer layer composed of at least one binder selected from the group which consists of waxes and plastic materials and at least one coloring agent incorporated in said binder, said transfer layer melting upon heating to a predetermined temperature to transfer a portion of said layer in a predetermined pattern; and (b) applying to one side of said transfer layer, a protective polymer layer by one of the steps of:

($b_1$) coating said side of said transfer layer with a solution or dispersion of a film-forming polymer nonmeltable at said predetermined temperature in a solvent or dispersing medium, and evaporating said medium from said solution or dispersion, and ($b_2$) coating said side of said transfer layer with at least one polymerizable substance selected from the group which consists of a monomer and a prepolymer, and subjecting said substance to in situ polymerization.

According to the invention, therefore, to a preformed layer of the wax-bonded and/or plastic-bonded melt color, a polymer layer by either evaporating the solvent or a dispersing agent from a solution or dispersion of a nonmeltable film-forming polymer, or subjecting to in situ polymerization a monomer and/or prepolymer which has been applied to the color-transfer layer so that in either case, a protective polymer layer is provided on the reverse side of the color transfer layer while the obverse or face of the color transfer layer member is free to transfer color in the manner previously described.

The starting point of the invention, therefore, is a layer of a wax-bonded and/or plastic-bonded melt color which is not applied to a carrier foil, but on the side of which it is to be turned toward the thermal printing head, is coated with a protective polymer layer.

The materials forming the protective polymer layer are inexpensive and the protective polymer layer can have a layer thickness of substantially 0.5 to 6 μm. It has been found that such a layer prevents contact of the printing head with the meltable color transfer layer and contamination of the printing head. Furthermore, the film-forming layer provides the requisite tensile strength and is sufficiently thin to allow transfer of closed symbols, for example, the letter "O" without transfer of the material in the central portion of the symbol. When the protective layer is not used at all, the printing of a closed symbol such as an "O" will result in filling-in of the symbol.

In any event, it is no longer necessary to provide a preformed support foil for the ribbon, such foils having generally been used in thicknesses of 3–20 μm. The plastic-bonded melt color can, of course, include a certain proportion of wax or waxlike materials. An important component of the melt color is advantageously a thermoplast. Thermoplasts are substances which at ambient temperature may be hard or even brittle plastics and which, upon heating, reversibly soften and are mechanically easily deformable, transforming to viscous layers at even higher temperatures. These materials pass through a softening or melting temperature range. For the purposes of the invention, the following thermoplastic synthetics can be used: polystyrene, polyvinylacetate, polyvinylacetal, polyvinylchloride, polyamides, polyethylene, vinylacetate and vinylchloride copolymers or polymerizates, polyvinylether, polyvinylpropionate, polyacrylate and ethylene/vinylacetate copolymers.

The thermoplastic binder or melt color can contain known plasticizers, for example, phthalic acid esters such as di-2-ethylhexylphthalate, diisononylphthalate and di-isodecylpthalate, aliphatic dicarboxylic acid esters such as those derived from adipic acids, especially di-2-ethylhexyladipate and di-isodecyladipate, phosphates such as triphenylphosphate, fatty acid esters such as triethyleneglycol-2-(2-ethylbutyrate) and the like. In certain cases, it has also been found to be advantageous to incorporate stabilizers in the thermoplastic binder or the melt color.

The wax-bonded and/or plastic-bonded melt color can contain conventional coloring agents, i.e. pigments and/or dye stuffs. As pigments, carbon black, organic and/or inorganic pigments of other colors and also so-called fillers such as chalk, china clay, kaolin, aluminum oxide and the like can be used.

The wax-bonded or plastic-bonded melt layer, which is provided in accordance with the invention with a polymer layer, can be made by any of the techniques hitherto used for this purpose provided, of course, that it does not remain adherent to a carrier foil. For example, it can be made by a casting process, extrusion, blowing, doctor blade coating or like application to an auxiliary carrier or thereafter removed from the auxiliary carrier. It can be made by a silk screen process or from a melt or solution with evaporation of the solvent or dispersing agent. It should be noted at this point that the term "dispersion" does not exclude a "solution", since a dispersion can have, apart from emulsified suspended particles, also dissolved matter.

For the formation of the protective polymer layer according to the invention, we may use various techniques. For example, a dispersion or solution of a film-forming polymer which is nonmeltable during the thermal printing process can be coated in a thin layer on the color transfer layer and the dispersing agent can be evaporated by passing over the coating warm air which can be at a temperature of, for example, 80° C.

The dispersing agent or solvent will depend upon the polymer selected and can be ethanol and/or water. Water, when used as a dispersing agent, has the advantage that it is environmentally satisfactory and not a contaminant.

When water is used as the solvent, polyvinylpyrrolidone and/or polyvinylalcohol may constitute the polymer. Dispersions, according to the invention, can include a variety of polymers in a concentration of the polymer phase of 10 to 40% by weight.

Application of the dispersion should be effected by various techniques. For example, the dispersion may be sprayed or printed onto the color transfer layer whether the dispersion utilizes water or an organic solvent such as alcohol. The dispersion may be applied by means of a doctor blade and a doctoring application may be used also for a solution.

After evaporation of the dispersing agent or solvent, the polymer forms a film which is a nonmeltable protective layer of the desired thickness of 0.5 to 15 μm and preferably 0.5 to 6 μm.

The protective layer can also be formed by polymerizing a suitable monomer for example, styrene or a substituted acrylate, or a suitable prepolymer, for example, a reactive acrylate resin, unsaturated polyester resin in a acrylate modified epoxy resin, or both by spraying or printing the monomer and/or prepolymer layer onto the plastic-bonded melt layer and effecting in situ polymerization, for example, by ultraviolet radiation.

The principal advantage of the method of the invention is that it eliminates the need for expensive carrier foils and related disposal problems.

In many cases, the thickness of the polymer layer applied as the protective layer can be less than 1 μm and, in general, this thickness need only be sufficient to exclude contact between the material layer and the thermal printing head.

A relatively thick carrier foil, by comparison, utilizes many times more material Furthermore, the thin protective layer allows closed letters to be printed with high resolution with a thin polymer layer by comparison to a thick carrier foil. The thermal transport during the printing process is improved, i.e. the color transfer layer is heated more effectively.

A very important advantage, of course, is the reduction in thickness of the ribbon because of the elimination of excess material hitherto required for the carrier foil which allows substantially more ribbon to be wound in the thermocolor ribbon cassette than has hitherto been the case. Of course, when water-soluble polymers are used to form the protective layer, there is the possibility of recovery and recycling in that the water soluble polymers can be recovered from the waxy residues and reused in the production of a thermocolor ribbon.

BRIEF DESCRIPTION OF THE DRAWINGS

The above objects, features and advantages of our invention will become more readily apparent from the following description, reference being made to the accompanying drawing in which:

FIGS. 1A and 1B are cross-sectional views of the color transfer layer and the ribbon of the invention;

FIG. 2 is a diagram showing the production of the ribbon according to the embodiment thereof; and FIG. 3 is a view similar to FIG. 2, but of a portion of a line for making the ribbon according to another embodiment.

SPECIFIC DESCRIPTION

In FIG. 1A, we have shown the melt color transfer layer 10 which is initially formed and to which as can be seen in FIG. 1B, a protective polymer coating 11 is applied by either of the techniques of FIG. 2 or FIG. 3.

For example, in the method illustrated in FIG. 2, a temporary support in the form of an endless support foil 12 is fed along a transport path 13 and receives a layer 10 of the meltable transfer color from a feeder 14 and a doctor blade 15. The color transfer layer is dried by passing hot air over the color transfer layer in a drying zone 16.

To the layer 10, a protective polymer layer 11 is applied from the feeder 17 and the doctor blade 18 and this protective polymer layer is then dried by evaporation of the solvent or dispersant in the drying zone 18.

The color transfer layer is then stripped at 19 from the support foil 12 which is recycled. The color transfer ribbon having the protective polymer coating is represented at 20 in FIGS. 1B and 2. As can be seen from FIG. 3, in place of the drying zone 18, when the layer 11 consists of a monomer and/or prepolymer, in situ polymerization can be effected in a zone 21 utilizing the lamp 22. The ribbon is then stripped as described in connection with FIG. 2.

SPECIFIC EXAMPLES

EXAMPLE 1

A color transfer layer is formed by applying to a polyester temporary support the following composition:

| | |
|---|---|
| toluene | 300 parts by weight; |
| propanol-(2) | 100 parts by weight; |
| ethylene-vinylacetate copolymer | 85 parts by weight; |
| carbon black | 15 parts by weight. |

After application of this composition to the temporary support foil, the solvent is evaporated by passing warm air thereover. The free surface of the thus formed color transfer layer having a thickness of of 6 μm is then coated with a mixture of 100 parts by weight water and 40 parts by weight of polyvinylalcohol (molecular weight: about 25000) and the water component is removed by passing warm air over the coating. The result is a protective polymer layer of about 4 μm in thickness. The thermocolor band is removed from the temporary support foil, wound in a roll and can be used directly in a thermal printing system of conventional type.

EXAMPLE 2

The color transfer layer is formed as in Example 1. Upon this color layer, a composition of 100 parts by weight water, 12 parts by weight 25% aqueous ammonia and 30 parts by weight vinylacetate-crotonic acid copolymer is coated. The water is removed by treating the coating with warm air. A 4 to 5 μm thickness protective polymer layer is formed on the color transfer layer and the ribbon is removed from the temporary support as in Example 1.

EXAMPLE 3

The process of Examples 1 and 2 is followed except that the color transfer layer is formed by a layer of 40 parts by weight ester wax, 33 parts by weight paraffin wax, 2 parts by weight polyvinylisobutylether, 5 parts by weight mineral oil and 20 parts by weight carbon black. The composition is applied as in the foregoing Examples and dried in the presence of warm air.

We claim:

1. A method of making a thermal-transfer ribbon which comprises the steps of:

(a) forming a transfer layer composed of at least one binder selected from the group which consists of waxes and plastic materials and at least one coloring agent incorporated in said binder, said transfer layer melting upon heating to a melting temperatures sufficient to transfer a portion of said layer in a symbol pattern; and (b) applying to one side of said transfer layer, a protective polymer layer by coating said side of said transfer layer with at least one polymerizable substance selected from the group which consists of a monomer and a prepolymer, and subjecting said substance to in situ polymerization, said monomer being selected from the group which consists of styrene and substituted acrylates, and said prepolymer being selected from the group which consists of reactive acrylate resins, unsaturated polyester resins and acrylate-modified epoxide resins.

2. The method defined in claim 1 wherein a monomer is coated onto said side of said transfer layer in step (b).

3. The method defined in claim 2 wherein said monomer is selected from the group which consists of styrene and substituted acrylates.

4. The method defined in claim 1 wherein a prepolymer is coated onto said side of said transfer layer in step (b).

5. The method defined in claim 4 wherein said prepolymer is selected from the group which consists of reactive acrylate resins, unsaturated polyester resins and acrylate-modified epoxide resins.

6. The method defined in claim 1 wherein said protective polymer layer is formed in step (b) on said transfer layer with a thickness of substantially 0.5 to 12 micrometers.

7. The method defined in claim 6 wherein said protective polymer layer is formed in step (b) on said transfer layer with a thickness of substantially 0.5 to 6 micrometers.

8. The method defined in claim 1 wherein said protective polymer layer is formed in step (b) on said transfer layer as an electrically conductive layer.

* * * * *